United States Patent [19]

Fleury et al.

[11] Patent Number: 4,949,761

[45] Date of Patent: Aug. 21, 1990

[54] SPHEROIDALLY CONTOURED FABRIC

[75] Inventors: Gilles A. Fleury, Garden Grove; Robert L. LaVallee, Perris, both of Calif.; Thomas S. Ohnstad, Marysville, Wash.

[73] Assignee: Ciba-Geigy Corporation, Ardsley, N.Y.

[21] Appl. No.: 280,801

[22] Filed: Dec. 7, 1988

Related U.S. Application Data

[62] Division of Ser. No. 77,672, Jul. 23, 1987.

[51] Int. Cl.[5] ..... D03D 3/00

[52] U.S. Cl. ..... 139/384 R; 139/386

[58] Field of Search ..... 139/11, 384 R, 386, 139/387, 388

[56] References Cited

U.S. PATENT DOCUMENTS

| | | | |
|---|---|---|---|
| 1,077,125 | 10/1913 | Doughty | 139/386 |
| 2,424,411 | 7/1947 | Moore | 139/386 |
| 2,998,030 | 8/1961 | Koppelman et al. | 139/387 R |

*Primary Examiner*—Henry S. Jaudon
*Attorney, Agent, or Firm*—Harry Falber

[57] ABSTRACT

A contoured continuous length fabric having warp yarns extending latitudinally thereof which are positioned closer together as they approach the outer contoured surface of the fabric and weft yarns extending longitudinally and being substantially equally spaced along the length thereof relative to each other.

3 Claims, 2 Drawing Sheets

FIG. 2
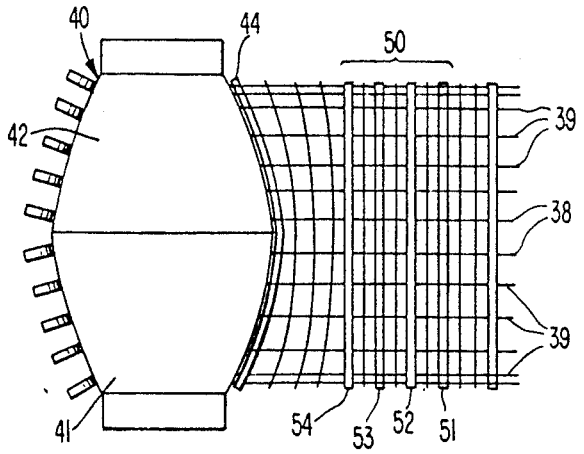
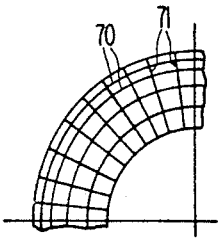
FIG. 3.

SPHEROIDALLY CONTOURED FABRIC

This is a divisional of application Ser. No. 077,672 filed on July 23, 1987.

This invention relates to a spheroidally contoured fabric produced from a yarns which is somewhat difficult to weave.

BACKGROUND OF THE INVENTION

The production of a spheroidally, or more particularly a spherically, contoured fabric of material which is difficult to weave, such as a carbon fiber material, has become desirable in recent times for use in the formation of shims for spherically shaped rocket nozzle parts, for use in the construction of parabolic antennae, and as bases or cores for radar domes made of resin or the like.

In the conventionally finished product, while the warp yarns or threads will be substantially circumferential around the axis of a sphere, in the nature of the latitude lines on a globe, the weft yarns or threads will not run in planes parallel to the axis of the sphere, in the nature of longitude lines on a globe, but rather will be caused to curve away from such positions from the larger diameter edge of the spherical portion to the smaller diameter edge. This problem will be discussed more fully hereinafter. This distortion of the position of the weft yarns or threads makes the fabric unsatisfactory.

Another property of spheroidally contoured fabric is that if it is shaped from fabric in which the weft yarns and warp yarns are uniformly spaced across the fabric, when the fabric is shaped into a spherical shape, the weft yarns will be closer together at the portion of the fabric nearer the pole of the sphere, i.e. the fibers lying along longitude lines of the sphere will converge toward the poles, so that the density of the fabric will increase toward the poles of the spheroid. This can be undesirable.

OBJECTS AND BRIEF SUMMARY OF THE INVENTION

It is the object of the invention to provide a spheroidally contoured fabric in which the density of yarns in the fabric is substantially constant throughout the area of the fabric.

The invention further relates to spheroidal shaped fabrics so produced, in particular to a spheroidally contoured continuous length fabric having warp yarns extending latitudinally and weft yarns extending longitudinally with respect to a pole of a sphere, said warp yarns being positioned closer together the further away from said pole they are positioned, and said weft yarns being substantially equally spaced around said sphere.

It is to be understood that the present invention is for use in producing spheroidal shaped fabrics. However, for simplicity of explanation, the description of the invention is directed only to spherically shaped fabric. It is not intended that the invention be so limited, however.

BRIEF DESCRIPTION OF THE FIGURES

Other and further objects of the invention will become apparent from the following description, taken in conjunction with the accompanying drawings, in which:

FIG. 2 is a plan view of a portion of the apparatus utilized for producing the fabric of the invention; and FIG. 3 is a schematic plan view of a part of an annular member formed from the spherically contoured fabric made according to the present invention.

DETAILED DESCRIPTION OF THE INVENTION

Figure 1A:
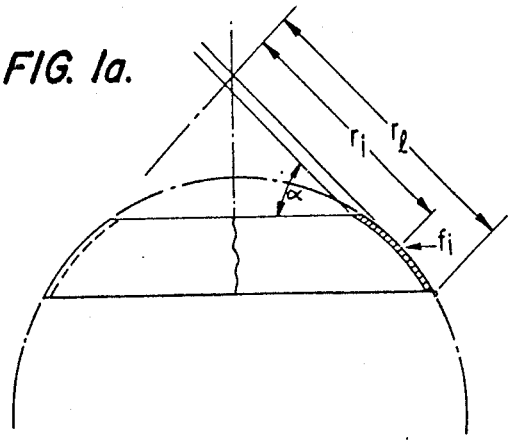
FIG. 1*a* is a side elevation view of an annular spherical shim made from spherically contoured fabric produced according to the present invention.
Figure 1B:
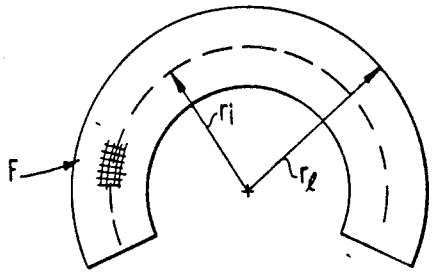
FIG. 1*b* is a plan view of a developed piece of fabric which can be formed into the shim of FIG. 1*a*.

One embodiment of the spherically contoured fabric product which it is desired to produce is shown in FIGS. 1*a* and 1*b*, and it consists of a spherically contoured piece of fabric preferably made of a difficult to weave yarn, such as low or medium modulus carbon yarn, which is to serve as an annular spherical shim for use in a rocket nozzle. The product, in its finished form as shown in FIG. 1*a*, is constituted by a section of a sphere, shown in broken lines, which is defined between two parallel planes which extend perpendicularly to the vertical axis of the sphere. As will be appreciated, the shim is designed to lie against the inside of a concave spherical part of the rocket nozzle to shim up a further part which fits into the spherical portion against which the shim rests. Thus, the configuration of the exterior of the shim is part of the surface of a sphere. As can be seen from the right-hand sectional portion, the cross section of the fabric will be circularly curved.

The product is made up from the developed shape as shown in FIG. 1*b*, and it will be appreciated that the cross section of the developed shape will be the same as that shown in the right-hand part of FIG. 1*a*, and when the shape lies convex side down on a surface, the shape will be slightly convexly curved upwardly.

It is this developed shape which is produced from the improved rapier-type loom according to the present invention.

As can be seen from the drawings, the outermost warp yarn f of the developed shape will be at a radius r from the center of the shape, and the intermediate warp yarn $f_i$ will be at radii $r_i$. The weft yarns will extend substantially radially across the warp yarns, as shown schematically at the poriton F in FIG. 1*b*.

The apparatus features which allow for the preparation of the fabric of this invention are depicted in FIG. 2. Of particular importance is the presence of a wrap yarn path length extending means generally indicated at 50 in FIG. 2. This means 50 in the preferred embodiment is a series of profiled members in the form of curved bars 51–54. The bars are curved to have a profile similar to that of the profile of the mandrel 40, and the first bar is positioned so that the profile projects in one direction transversely to the path of the fabric, in this embodiment upwardly of the path of the fabric, and the next curved bar 52 having a similar profile projecting in the opposite direction transversely to the path of the fabric, i.e. downwardly from the path of the fabric. The third curved bar projects in the one direction, i.e. upwardly, and the fourth curved bar projects in the other direction, i.e. downwardly. The fabric moving from the shed to the mandrel is diverted back and forth across the normal path of the fabric over each of the bars until it reaches the guidebar 44.

The maximum point of projection of the contour of the bar is at the position corresponding to the center of the longitudinal length of the mandrel 40, and the lowest point on the profile of the bars corresponds to the position of the ends of the mandrel and lies along the path of the fabric.

It will be seen that the warp yarn or yarns which lie along the center of the fabric will be diverted by the first bar 51 out of the normal direct path from the position of the shed to the guide bar 44 a maximum distance above the path, and then diverted by the second bar 52 out of the normal direct path a distance below the normal path of the fabric. These central warp yarns are then directed above and below the normal path again.

The warp yarns at the opposite edges of the fabric, on the other hand, will simply be guided along the ends of the bars in the normal path of the fabric.

the profiles of the bars and the number of bars is determined so that the combination of the normal shorter path length for the mid-fabric warp yarns and their increased velocity will be completely compensated for, so that the portions of the weft yarns carried by these warp yarns will reach the mandrel 40 at the same time as the end portions of the weft yarns held by the warp yarns at the side edges of the fabric. As shown in FIG. 2, this will mean that by the time the weft yarns have reached the guide bar 44, they will not only not have the ends lagging the center, but in fact the ends will have moved forward of the center and the curvature of the weft yarns will correspond to the profile of the mandrel 40. Thus, when the fabric is guided over the guide 44 onto the mandrel 40, the weft yarns will lie along lines corresponding to longitudinal lines on the spherical shape of the mandrel portions 41 and 42. As a result, the finished fabric when it is taken off will have a spherical shape, yet the warp yarns and the weft yarns will be in the proper longitudinal and latitudinal relationship in relation to the spherical shape of the fabric.

In view of the configuration of mandrel portions 41 and 42, in essence two linked spheroidal portions are provided.

This approach provides the spheroidally contoured fabric, specifically a spherically contoured fabric, with a construction which has the desirable property that the yarn density is more uniform throughout the fabric.

As pointed out above, if the warp yarn supplied to the loom for making the spherically shaped fabric are uniformly spaced across the width of the fabric, these warp yarns in the finished fabric will be in the positions corresponding to latitudinal lines on a sphere, and will be at equal distances from each other across the surface of the sphere. The weft yarns, on the other hand, will correspond to longitudinal lines on the sphere and will converge toward the poles of the sphere. As a result, the density of the fabric, i.e. the number of yarns per unit area, will increase toward the poles.

To change this property, the present invention provides for causing the warp yarns toward the center of the width of the fabric, i.e. toward the larger diameter part of the finished spherically contoured fabric, to be closer together than at the edges of the fabric. As a result, as shown in FIG. 3, the yarns 70 lying along the latitudinal lines will be closer together toward the larger diameter part, and become progressively further apart the closer to the small diameter part they lie. By properly spacing the warp yarns in the loom, the number of fibers 70 and 71 per unit area of the fabric can be made substantially uniform.

Although the invention has been described by way of example with respect to only a single embodiment, it will be understood that various changes and modifications may be made without departing from the scope and spirit of the invention, and it is intended that such changes and modifications be included within the scope of the appended claims.

What is claimed is:

1. A curved contoured continuous length fabric having warp yarns extending latitudinally along the length of said fabric and weft yarns extending longitudinally across the width of said fabric, said warp yarns being positioned closer together, as they approach the outer curved surface of the fabric, and said weft yarns being substantially equally spaced lengthwise relative to each other.

2. The fabric as claimed in claim 1 having a substantially uniform number of yarns per unit area.

3. The fabric as claimed in claim 1 comprising yarns selected from the group consisting of carbon, E-glass and S2-glass yarns.

* * * * *